US006536972B2

(12) United States Patent
Bramlett et al.

(10) Patent No.: US 6,536,972 B2
(45) Date of Patent: Mar. 25, 2003

(54) INKJET STYLUS

(75) Inventors: Brian W. Bramlett, Portland, OR (US); Frank T. Brown, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/816,550

(22) Filed: Mar. 23, 2001

(65) Prior Publication Data

US 2002/0136587 A1 Sep. 26, 2002

(51) Int. Cl.[7] ..... A46B 11/00
(52) U.S. Cl. ..... 401/16; 401/195; 347/109
(58) Field of Search ..... 401/31, 17, 16, 401/195; 347/109; 400/88

(56) References Cited

U.S. PATENT DOCUMENTS 4,758,849 A * 7/1988 Piatt et al. ..... 347/109
5,388,924 A * 2/1995 Chao ..... 401/198
5,501,535 A * 3/1996 Hastings et al. ..... 347/109
5,599,122 A * 2/1997 Yu ..... 401/31
5,988,900 A * 11/1999 Bobry ..... 347/109
6,347,868 B1 * 2/2002 Headrick et al. ..... 347/109

* cited by examiner

*Primary Examiner*—David J. Walczak
(74) *Attorney, Agent, or Firm*—Marger Johnson & McCollom, P.C.

(57) ABSTRACT

The inkjet stylus includes a nozzle for depositing ink onto a writing surface. The ink is drawn from an ink cartridge, which may contain a plurality of ink containers, each holding a different color ink. A switch mechanism is used to select different combinations of ink to produce different colors. A microcontroller controls the switch mechanism so as to select the combination of inks that will produce the desired color, and also controls how the ink is deposited on the writing surface using the nozzle. A battery powers the electronic devices in the inkjet stylus.

34 Claims, 4 Drawing Sheets

INKJET STYLUS

RELATED APPLICATION DATA

This invention is related to commonly assigned U.S. patent application Ser. No. 09/816,556, titled "Coordinated Knob and Display For Navigation of Hierarchical and Range Selectors," filed Mar. 23, 2001, incorporated by reference herein.

FIELD OF THE INVENTION

This invention pertains to a writing device, and more particularly to a writing device incorporating multiple colors.

BACKGROUND OF THE INVENTION

The arts of writing and drawing are ancient ones. Cave paintings are some extraordinarily early examples of drawing. And written language goes back at least as far as Egyptian culture.

But there have always been limits to what can be done with writing and drawing. First and foremost is the limitation of "one pen=one color and pen size." Even today, graphic artists have tremendous numbers of pens, each dedicated to a single combination of color and nib size. Further, manufacturers generally limit the color choices available to artists. When the graphic artist wants a different color or to use a different nib, the graphic artist must change pens, and find a pen with the best match for the desired color.

Painters typically work with only a few brushes of different sizes, and mix their own colors. But even with only a few brushes, changing the size of the brush requires changing brushes. Further, reusing brushes requires cleaning them with chemicals. And mixing colors on a palette is difficult work, requiring a high degree of skill to know what colors to mix and in what proportions.

The present invention addresses this and other problems associated with the prior art.

DETAILED DESCRIPTION

Figure 1:
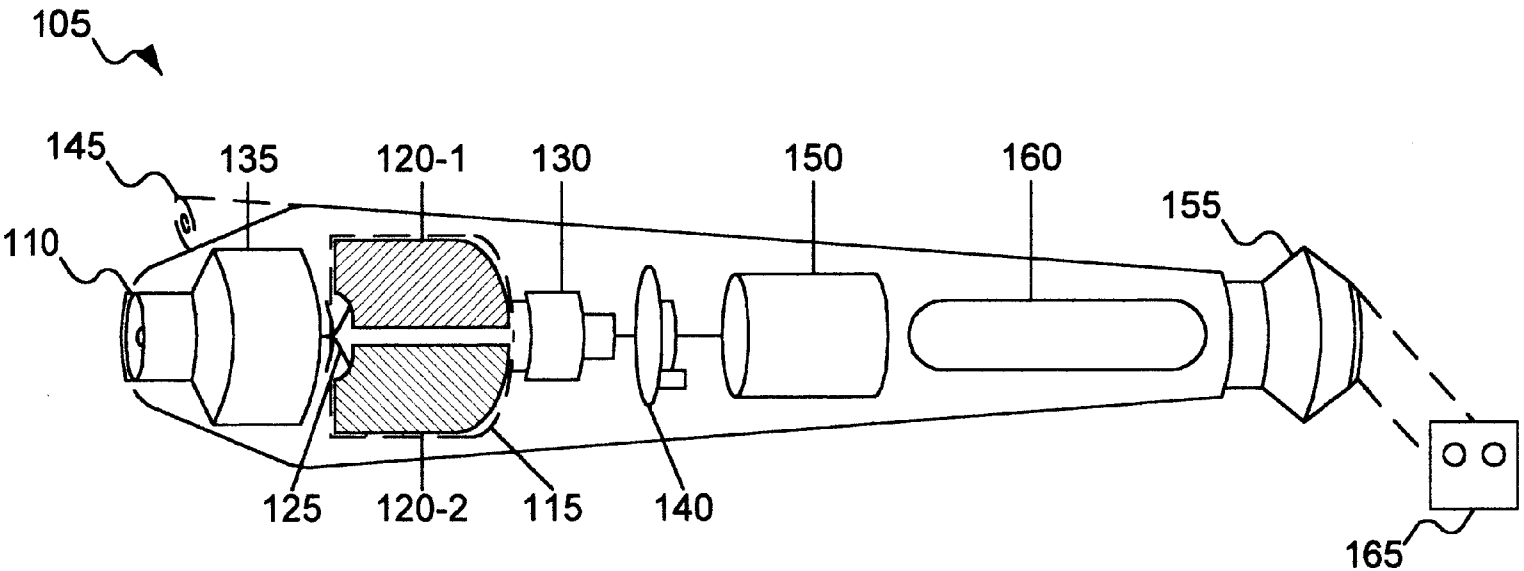
FIG. 1 shows an inkjet stylus according to an embodiment of the invention.

FIG. 1 shows an inkjet stylus according to an embodiment of the invention. In FIG. 1, inkjet stylus 105 includes nozzle 110. Nozzle 110 is responsible for applying ink to the surface of the paper. The ink is drawn from ink cartridge 115. Ink cartridge 115 includes ink containers, such as ink containers 120-1 and 120-2, which store the ink fed to nozzle 110. In one embodiment, ink cartridge 115 includes 4 ink containers, storing inks in the colors cyan, yellow, magenta, and black, which can be mixed to produce any desired color. However, a person skilled in the art will recognize that ink cartridge 115 may include more or fewer ink containers, and may include different colors of ink. Ink cartridge 115 may be designed so that the ink containers are individually replaceable, or may only be replaced as a unit with the ink cartridge. Ink cartridge 115 also includes valves, such as valve 125. Valve 125 delivers ink from the ink container within ink cartridge 115 to nozzle 110.

Switch mechanism 130 is responsible for selecting the colors of ink to be delivered to the nozzle. Switch mechanism may specify that any combination of colors in ink cartridge 115 be delivered to nozzle 110 by the valves. This also includes the possibility of a single color (i.e., ink is drawn from only one ink container). The inks drawn from the containers are then mixed in the correct proportion to produce the desired color of ink that is applied to the writing surface by nozzle 110.

Inkjet stylus 105 also includes motion sensor 135. Motion sensor 135 is responsible for sensing the movement of inkjet stylus 105. When inkjet stylus 105 is lifted from the writing surface, motion sensor 135 senses this and stops the flow of ink through nozzle 110. In various embodiments, motion sensor 135 may include pressure sensors to detect when nozzle 110 is no longer pressed to the writing surface, an optical surface to detect when inkjet stylus 105 is moved by changes in light, and accelerometers to determine when inkjet stylus 105 has moved relative to a starting point on the writing surface.

In a second embodiment, inkjet stylus 105 not only writes in any desired color, but also writes using any desired line style. For example, inkjet stylus 105 may write using a variety of line widths. Alternatively, inkjet stylus 105 may write using a line pattern, so that when the user draws a line, portions of the line are inked, and other portions of the line are left blank. In this embodiment, motion sensor 135 senses the movement of inkjet stylus 105 to determine when nozzle 110 should apply ink to the writing surface and when nozzle 110 should not apply ink.

Microcontroller 140 controls the application of ink to the writing surface via nozzle 110 (depending on the line style being used). Microcontroller 140 receives input from motion sensor 135 and instructs nozzle 110 when to apply ink and how much ink to apply. Microcontroller 140 is also responsible for instructing the ink containers within ink cartridge 115 to dispense ink via the valves. In this manner, microcontroller 140 is responsible for selecting the colors of ink to be mixed for application by nozzle 110 to the writing surface.

Because inkjet stylus 105 requires power, battery 150 provides the necessary power to the electronics within inkjet stylus 105. This includes microcontroller 140, switch mechanism 130, and nozzle 110, among other electronic components. A person skilled in the art will recognize that other power sources than a battery may also be used. For example, other "untethered" power sources may also be used, such as fuel cells, and "tethered" power sources, such as an alternating current adapter and cable, may also be used.

In an alternative embodiment, inkjet stylus 105 includes color sensor 145. Color sensor 145 samples a color to which inkjet stylus 105 is pointed. Microcontroller 140 then determines the appropriate combination of colors of ink to mix to produce the sampled color. (The combination of colors needed to produce the sampled color may be stored in a memory, not shown in FIG. 1.) Color sensor 145 may include a calibrated light source to sample the color source.

In an alternative embodiment, inkjet stylus 105 may include a selection device, which may be used to select a desired ink color or line style. In FIG. 1, the selection device includes knob 155 and display 160. Knob 155 is used to navigate a menu. Twisting knob 155 allows a user to view the different choices within the menu: for example, to select a desired ink color or line style. Pushing or pulling knob 155 allows the user to select or reject a current choice in the menu. A person skilled in the art will recognize that either pushing or pulling knob 155 may be used to select or reject a selection, but it is more intuitive to push knob 155 in the direction of selection device 1 OS to select a menu choice.

As the user navigates the menu using knob 155 (both by twisting knob 155 and by pushing or pulling knob 155), display 160 is updated to reflect the current choice. Thus, as the user twists knob 155, display 160 scrolls up/down to reflect the change in the selection, "rotating" the selection in display 160 to correspond with the direction knob 155 is rotated. Then, when the user selects or rejects a selection, display 160 scrolls left/right to reflect the selection or rejection of a choice in the menu.

The menu navigated by the user is stored in a memory within inkjet stylus 105 (not shown in FIG. 1). If the menu initially includes ink colors and line styles, as more colors and line styles are introduced to inkjet stylus 105, the menu may grow. For example, in the embodiment shown in FIG. 1, inkjet stylus 105 may include plug 165 to which a second device may be connected. The menu update may then be downloaded from the second device (which may be a computer or any other device with which inkjet stylus 105 may interoperate). Alternatively, in a second embodiment, the mechanism for updating the display may include a wireless receiver (not shown in FIG. 1), which may be used to receive updates to the menu.

The menu may have only a single level (with one or more selections), or it may have multiple levels. If the menu has multiple levels, then some selections within the menu will cascade to a lower level menu. Accepting these selections will open the lower level menus. Conversely, if the user is at a lower level menu and rejects a selection, the user will be brought to a higher level menu.

Figure 2:
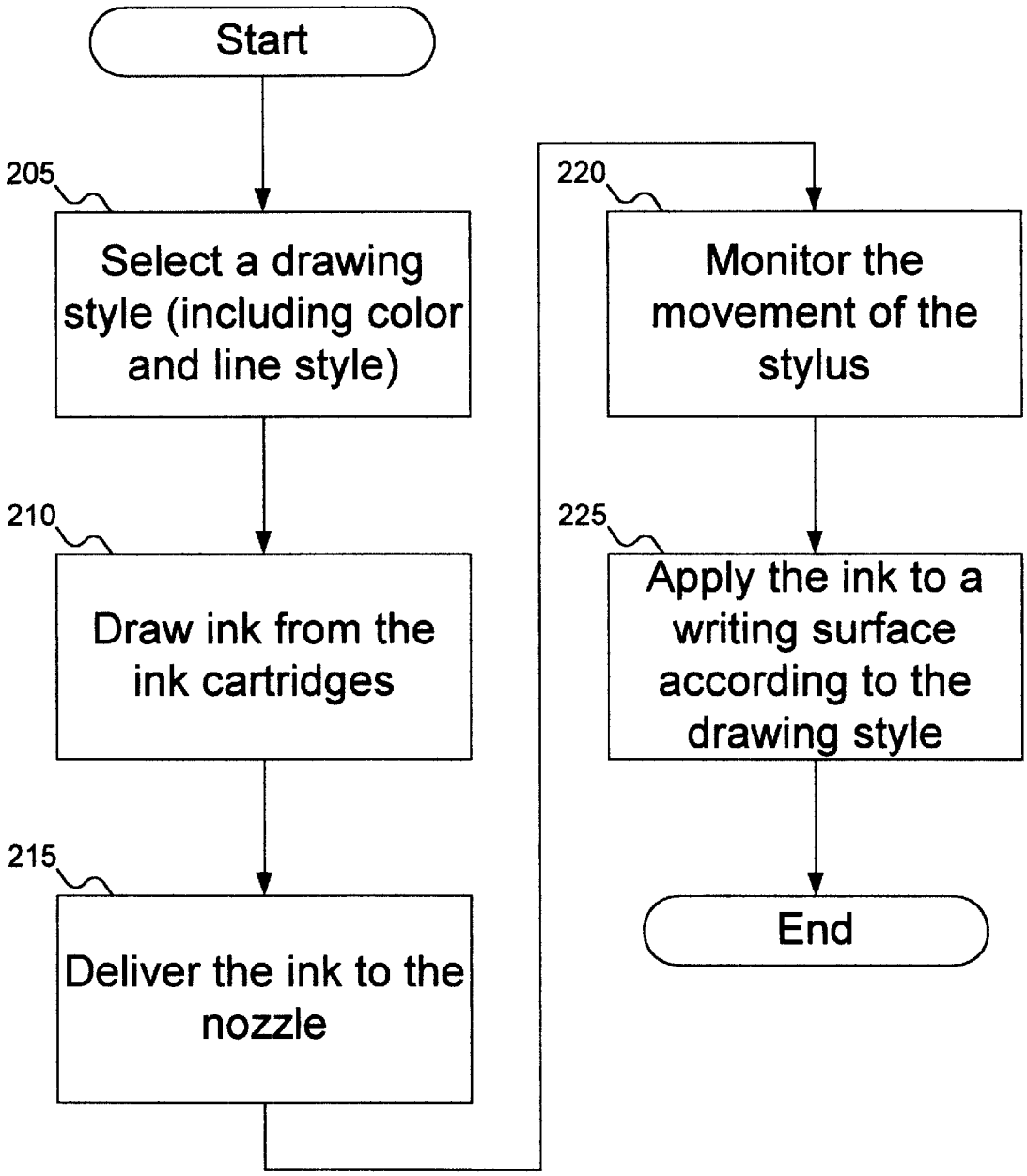
FIG. 2 shows the procedure used by the inkjet stylus of FIG. 1 to write on a piece of paper.

FIG. 2 shows the procedure used by the inkjet stylus of FIG. 1 to write on a piece of paper. At block 205, the user selects a drawing style (for example, a desired ink color and/or line style). At block 210, ink is drawn from the ink cartridge. Ink may be drawn from more than one ink container within the ink cartridge, so that when the colors of ink drawn are mixed, they produce the desired ink color. At block 215, the ink is delivered to the nozzle. At block 220, the movement of the stylus is monitored to make sure that ink is only applied to the writing surface and not randomly squirted into the air. Motion and pressure sensors within the stylus determine whether the stylus is moving and in contact with the writing surface. This also insured that when the stylus is not in motion (for example, if the user stops moving the stylus because he is in thought), ink does not continue to saturate the writing surface even if pressure is applied. Finally, at block 225, the ink is applied to the writing surface according to the drawing style, so that the correct color ink, line style, and other parameters are used.

Figure 3:
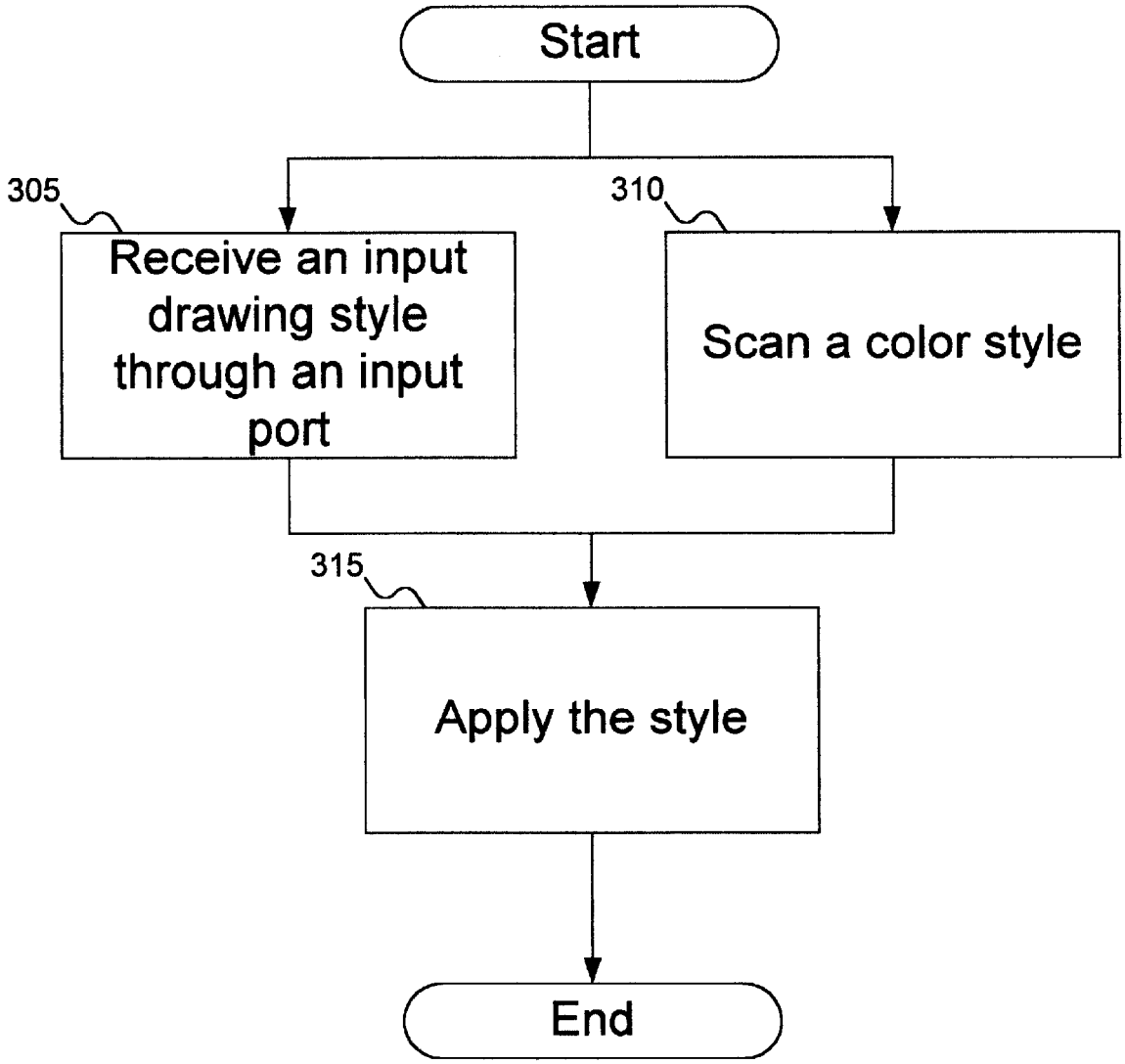
FIG. 3 shows the procedure used by the inkjet stylus of FIG. 1 to apply a new style.

FIG. 3 shows the procedure used by the inkjet stylus of FIG. 1 to apply a new style. In FIG. 3, there are two ways a new style may be applied. At block 305, a new drawing style is input through a port in the inkjet stylus. As described with reference to FIG. 1, this input port may be a port on the stylus to which a second device can be plugged, or the input port may be a wireless receiver designed to receive the drawing style via a wireless transmission (utilizing, for example, radio-frequency (RF) transmission, infrared transmission, Bluetooth, or any other wireless communication protocol). Alternatively, at block 310, the color style can be scanned by the stylus itself using a color sensor. Either way, at block 315, the new style may be applied.

Figure 4:
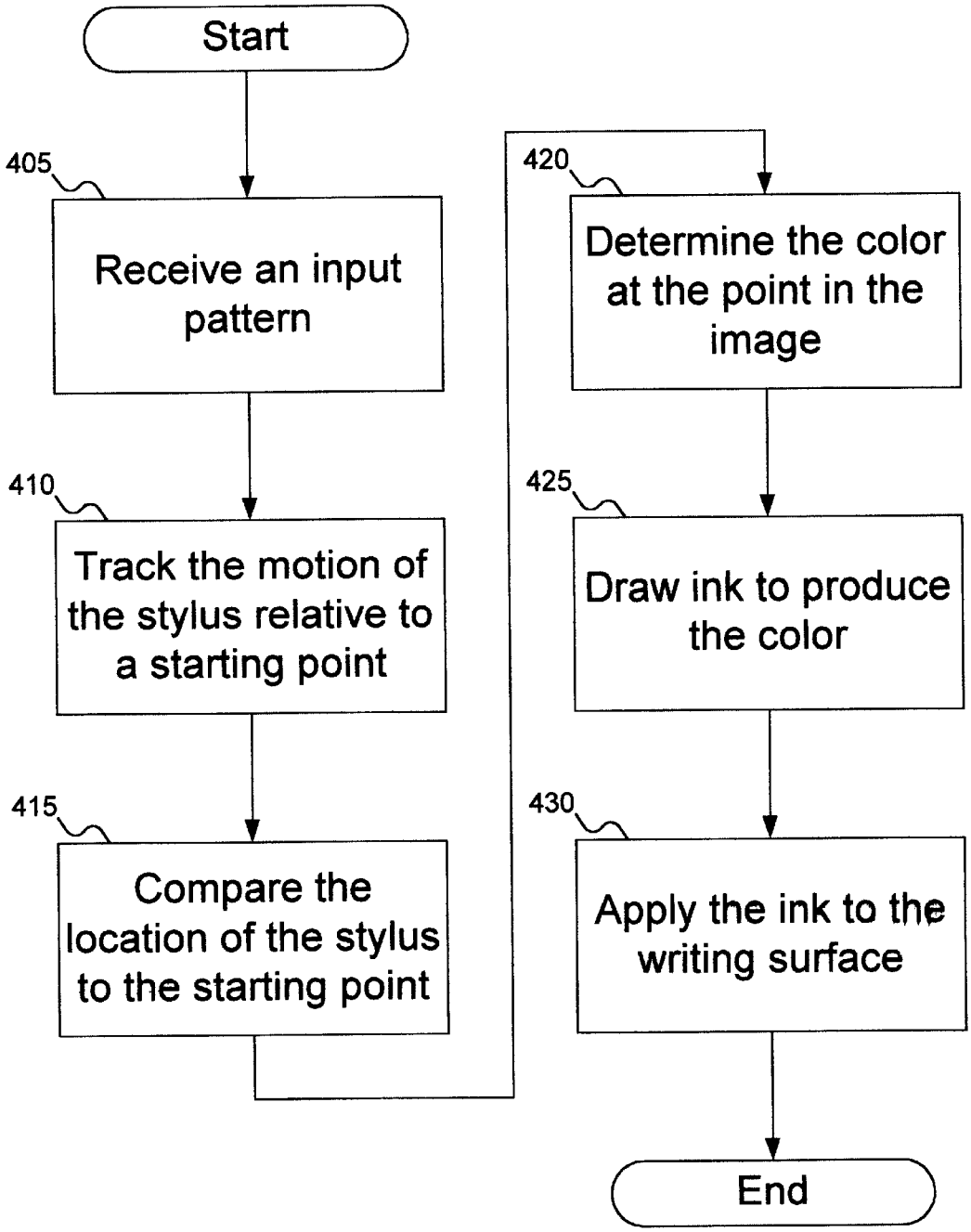
FIG. 4 shows the procedure used by the inkjet stylus of FIG. 1 to draw a picture.

Another use for the embodiments of the invention is to reproduce an input picture. FIG. 4 shows the procedure used by the inkjet stylus of FIG. 1 to draw a picture. At block 405 the inkjet stylus receives the input pattern (i.e., the picture). As discussed above, the pattern may be input using an input port or may be received wirelessly. At block 410, the motion of the inkjet stylus is tracked relative to a starting point. At block 415, the current point of the inkjet stylus is compared to the starting point. The corresponding point in the input pattern is determined, and at block 420 the color of that point in the input pattern is determined. At block 425, ink is drawn that, when mixed, produces the color of the point in the input pattern. Finally, at block 425, the ink is applied to the writing surface. Then, as the user moves the stylus around on the writing surface, eventually the pattern will be completely reproduced.

Having illustrated and described the principles of our invention in an embodiment thereof, it should be readily apparent to those skilled in the art that the invention can be modified in arrangement and detail without departing from such principles. We claim all modifications coming within the spirit and scope of the accompanying claims.

We claim:

1. A pen, comprising:

a plurality of inks;

a switch mechanism designed to select a combination of the plurality of inks;

a nozzle designed to apply the combination of inks to a writing surface;

a microcontroller designed to control the switch mechanism and the nozzle; and a power source designed to power the switch mechanism, the nozzle, and the microcontroller.

2. A pen according to claim 1, the pen further comprising an ink cartridge storing the plurality of inks.

3. A pen according to claim 1, the pen further comprising a sensor designed to track a motion of the pen.

4. A pen according to claim 3, wherein the sensor includes an accelerometer.

5. A pen according to claim 3, wherein the sensor includes an optical sensor.

6. A pen according to claim 1, the pen further comprising a pressure sensor.

7. A pen according to claim 1, the pen further comprising a color sensor.

8. A pen according to claim 7, wherein the color sensor includes a calibrated light source.

9. A pen according to claim 7, wherein the color sensor is designed to scan a color use by the pen.

10. A pen according to claim 1, the pen further comprising a selection device.

11. A pen according to claim 10, wherein the selection device includes:

a display designed to present a selection; and a selector operable in two independent axes, a first axis for changing the selection and a second axis for acceptance or rejection of the selection.

12. A pen according to claim 11, wherein the selection is drawn from a set including a plurality of pen colors, patterns, and line widths.

13. A pen according to claim 1, wherein the nozzle is designed to generate a plurality of patterns and line widths.

14. A pen according to claim 1, the pen further comprising data input means.

15. A pen according to claim 14, wherein the data input means includes a connector designed to accept a connection from a device.

16. A pen according to claim 14, wherein the data input means includes a receiver designed to wirelessly receive data from a device.

17. A pen according to claim 14, wherein the data input means are designed to receive a drawing style for the pen.

18. A pen according to claim 1, wherein the power source is a battery.

19. A method for using a pen, the method comprising:

navigating a menu using a selection device, the menu including at least a style and at least one level, the selection device operable in two independent axes, a first axis for changing the style and a second axis for acceptance or rejection of the style;

selecting the style;

displaying the selected style in a display;

drawing ink from an ink cartridge;

delivering the ink to a nozzle; and applying the ink to a writing surface using the nozzle.

20. A method according to claim 19, wherein navigating a menu includes updating the display as the selected style changes.

21. A method according to claim 19 wherein drawing ink includes:

drawing ink from a plurality of containers in the ink cartridge; and mixing the inks to produce a desired color.

22. A method according to claim 19, wherein applying the ink includes applying the ink in a pattern to the writing surface using the nozzle.

23. A method according to claim 19, wherein applying the ink includes applying the ink in a line width to the writing surface using the nozzle.

24. A method according to claim 19, wherein:

the method further comprises:

receiving an image into a memory in the pen;

determining a location of the pen relative to a starting point on the writing surface; and identifying a point in the image corresponding to the location of the pen; and drawing ink includes printing the point.

25. A method according to claim 24, wherein printing the point includes:

determining a color for the point in the image; and printing the color for the point.

26. An article comprising:

a storage medium, said storage medium having stored thereon instructions, that, when executed by a pen, result in:

navigating a menu using a selection device, the menu including at least a style and at least one level, the selection device operable in two independent axes, a first axis for changing the style and a second axis for acceptance or rejection of the style;

selecting the style;

displaying the selected style in a display;

drawing ink from an ink cartridge;

delivering the ink to a nozzle; and applying the ink to a writing surface using the nozzle.

27. An article according to claim 26, wherein drawing ink includes:

drawing ink from a plurality of containers in the ink cartridge; and mixing the inks to produce a desired color.

28. An article according to claim 26, wherein:

the storage medium has further stored thereon instructions, that, when executed by the pen, result in:

receiving an image into a memory in the pen;

determining a location of the pen relative to a starting point on the writing surface; and identifying a point in the image corresponding to the location of the pen; and drawing ink includes printing the point.

29. An article according to claim 28, wherein printing the point includes:

determining a color for the point in the image; and printing the color for the point.

30. An article according to claim 26, wherein navigating a menu includes updating the display as the selected style changes.

31. An article according to claim 26, wherein applying the ink includes applying the ink in a pattern to the writing surface using the nozzle.

32. An article according to claim 26, wherein applying the ink includes applying the ink in a line width to the writing surface using the nozzle.

33. An article according to claim 26, wherein applying the ink includes applying the ink to the writing surface using the nozzle in the selected style.

34. A method according to claim 19, wherein applying the ink includes applying the ink to the writing surface using the nozzle in the selected style.

* * * * *